United States Patent [19]

Heiliger

[11] Patent Number: 5,051,039

[45] Date of Patent: Sep. 24, 1991

[54] HYDRAULIC STEEL MINE PROP

[76] Inventor: Martha-Catharina Heiliger, Hochkoppel 11, D 5166 Kreuzau-Untermaubach, Fed. Rep. of Germany

[21] Appl. No.: 490,653

[22] PCT Filed: Jul. 1, 1989

[86] PCT No.: PCT/DE89/00436

§ 371 Date: Mar. 2, 1990

§ 102(e) Date: Mar. 2, 1990

[87] PCT Pub. No.: WO90/00217

PCT Pub. Date: Jan. 11, 1990

[30] Foreign Application Priority Data

Jul. 4, 1988 [DE] Fed. Rep. of Germany ..... 8808519

[51] Int. Cl.[5] ..... E21D 15/44

[52] U.S. Cl. ..... 405/290; 405/288

[58] Field of Search ..... 405/290, 291, 294, 295, 405/296; 91/170 MP; 248/351

[56] References Cited

U.S. PATENT DOCUMENTS 2,621,631 12/1952 Dowty ..... 405/290 X 4,252,476 2/1981 Koppers et al. ..... 405/290

*Primary Examiner*—Dennis L. Taylor

*Attorney, Agent, or Firm*—W. G. Fasse

[57] ABSTRACT

Hydraulic steel mine prop having a bottom ram including an outer cylindrical tube (1) having a cylinder bottom (14) and an end collar (16), as well as a top ram guided coaxially slideably in the bottom ram by the end collar (16) and a guide ring (12). The top ram is a cylindrical tube (2) comprising a piston (9) sealed and guided relative to the inner wall of the outer cylindrical tube (1). A prop head (4), a setting and withdrawal valve (21), an inner extension stroke limiter, and a return spring (6) are also provided. Each of the outer and the inner cylindrical tubes is received at its facing ends by corresponding projections or facing end grooves of the end collar or piston at one end and at the prop head or cylinder bottom at the other end. Seals are provided at least at the piston, the prop head, and the cylinder bottom. An element is provided between the prop head and the piston for taking up tension forces between these two structural parts. A further tension element (7) arranged coaxially to the cylindrical tubes, is attached to the cylinder bottom. The element (7) extends as a holding rod through the piston and has a holding element (8) at its free end. A compression spring (6) is arranged coaxially to the tension element to act as a return spring.

28 Claims, 6 Drawing Sheets

HYDRAULIC STEEL MINE PROP

FIELD OF THE INVENTION

The invention relates to a hydraulic steel mine prop having a bottom ram and a top ram.

BACKGROUND INFORMATION

The bottom ram in a hydraulic steel mine prop includes an outer cylindrical tube with a cylindrical floor and an end collar. The top ram in such props is guided on the one hand coaxially slideably in the bottom ram by the end collar with at least one guide ring. The top ram basically includes a cylindrical tube enclosing a piston sealed off and guided relative to the inner wall of an outer cylindrical tube, a prop head, a setting and withdrawal valve, and an inner stroke limitation and a return spring.

A mine prop of the above described type has, for example, become known from the German Patent Publication (DE-OS) 3,541,871. Such mine props have been completely successful regarding their functionality. Such steel mine props are known in numerous structural variations. Due to their great weight, attempts have already been made to produce such mine props of light metal. However, such light metal mine props are not usable wherever the danger of firedamp exists, because even slight impacts on the light metal tubes can produce sparks which then can cause a gas explosion. Moreover, such light metal mine props are also about twice as expensive as corresponding steel mine props. In steel mine props of the known type, an outer cylindrical tube is welded to a cylindrical floor or a prop foot. Because this outer cylindrical tube serves as a running bushing for the inner piston of the inner cylindrical tube, normally it is machined precisely by drilling and subsequent grinding or honing. It is furthermore surface treated, for example, with cadmium or zinc. A groove is turned-in in the head region of the outer prop tube for holding the end collar with the handle , which is arranged in that region, whereby the holding is achieved by means of a groove wire, which is laid into the corresponding groove. The end collar additionally function as an extension stroke stop for the inner cylindrical tube. In order to determine the extension stroke length, a stop bushing is inserted between the inner cylindrical tube and the outer cylindrical tube, and is taken along by the piston of the inner cylindrical tube during the extension stroke movement. Depending on the length of this stop bushing, the stop bushing will abut against the stop surface of the end collar with the inner cylindrical tube driven out more or less far, whereby a further extension of the inner cylindrical tube becomes impossible. The end collar in turn represents a second guide for the inner cylindrical tube. However, the end collar must now take up the full axial force created by the prop and transfer this force through the groove wire onto the outer cylindrical tube. Due to the fact that the outer cylindrical tube is welded to a cylindrical bottom, easily weldable material must be used for this tube and therefore high strength steel alloys cannot be used. Due to the arising load, pressures of about 400 bar arise in the outer cylindrical tube, this cylindrical tube has a correspondingly large wall thickness and therewith a corresponding weight. Here it must be remembered that transportation and erection of such mine props in practice is done exclusively manually.

The valve housing for the setting and withdrawal valve is welded on at a suitable location. This welding work and the welding work by means of which the outer prop tube is welded to the bottom, produces deformations, which, on the one hand, negatively influence the tight sealing of the valve insert and, on the other hand, damage the mentioned surface treatment of the tubes.

Moreover, it is to be considered that turning-in the groove for the groove wire of the end collar weakens the outer prop tube so that a corresponding increase in wall thickness is necessary.

The internal stop sleeve can easily become encrusted and thereby prevent pushing the prop tubes together. Moreover, because this sleeve moves along with the extension and withdrawal motion of the inner prop, damage to the surface protection of the inner surface of the outer prop is unavoidable.

From the described structural features it can be seen that the known construction of steel mine props is very heavy, and it can easily be recognized that repairing such props is not possible without qualified personnel and without technical equipment including high quality machine tools. In any case, independently thereof, when making repairs at least the surface protection of the prop tubes will be damaged. Moreover, because different lengths of steel mine props are required due to the different structural heights, a suitable number of the required different lengths must always be kept in stock. It is not possible to produce such mine props according to requirements in an above-ground workshop on site. According to the above mentioned DE-OS 3,541,871, it is already seen as a great advance that a prop assortment of "only" eight different lengths must be produced for the different structural heights arising in practice.

OBJECTS OF THE INVENTION

In view of the foregoing, it is the object of the innovation to suggest a hydraulic steel mine prop of the initially described type which is relatively cheaper to produce and simpler to handle. It shall be more easily repairable and allow a less expensive stock storage. Moreover, with the same support force and length, it shall be lighter and less susceptible to interference by dirt contamination. It shall also be possible to produce it on site in the length required for the particular application.

SUMMARY OF THE INVENTION

These objects have been achieved according to the invention in a hydraulic steel mine prop of the initially described type, wherein the outer and the inner cylindrical tube each respectively is received at its facing ends by corresponding projections or face end grooves of the end collar or the piston, on the one hand, and the prop head or the cylindrical bottom, on the other hand, and wherein seals are provided at least at the piston, at the prop head and at the cylindrical bottom. Furthermore, an element is provided between the prop head and the piston for taking up tension forces between these two structural parts. A further tension element arranged coaxially to the cylindrical tubes, is attached at the cylindrical bottom and extends as a mounting rod through the piston, and has a holding element in the region of the free end, whereby a compression spring is arranged coaxially to the tension element to act as a return spring, one end of which is supported at the holding element and the other spring end is supported at the element which takes up the tension forces, or at the piston, or at a structural component connected to the element or the piston. The connection between the setting and withdrawal valve, on the one hand, and the pressure chamber, on the other hand, passes through the prop head or the cylindrical bottom. The construction suggested according to the invention does not require any welding work. Hence, it is no longer necessary to select a material which can be easily welded. Rather, in contrast to the prior art, a high strength material may be selected for example for the cylindrical tubes, whereby the wall thicknesses of the cylindrical tubes can be kept thinner and the prop becomes lighter. The prop tubes, at their respective facing ends, are simply set onto corresponding projections or set into corresponding grooves, where they are no longer welded, but are merely sealed off. This sealing can be achieved for example, by means of an inner 0-ring and, if necessary, additionally by an outer 0-ring. However, it is preferably achieved by means of the conventionally known and highly effective liquid seals, which cure at room temperature and remain absolutely tightly sealed even at the highest pressures. This simple application of the cylindrical tubes with simple sealings is possible because appreciable axial tensile loads need no longer be taken up by the cylindrical tubes in the prop according to the invention. Thus, it is also possible to supply the prop in its individual parts without the cylindrical tube and to have in stock or to deliver tubes as yard goods, which tubes have been appropriately pre-machined and surface-treated if necessary. If a steel mine prop is to be produced for a particular structural extension height, then it is simply necessary to cut off at appropriate lengths, for instance by sawing, the cylindrical tubes which have been stocked as yard goods, to debur the saw cut ends of the tubes, to simply join the tubes with the respective facing end components, and to seal the tubes to the other components by means of the liquid seal, for example. No welding work is necessary, and the distortion of the tube, caused by welding, is avoided. Also, damage to the treated surface is avoided. The damages caused in the cutting region by cutting off the tube, disappear in the seal and are thereby harmless.

BRIEF DESCRIPTION OF THE DRAWINGS

The invention will now be described in greater detail with reference to various example embodiments depicted in the accompanying drawings; wherein.

DETAILED DESCRIPTION OF PREFERRED EXAMPLE EMBODIMENTS AND OF THE BEST MODE OF THE INVENTION

Figure 1:
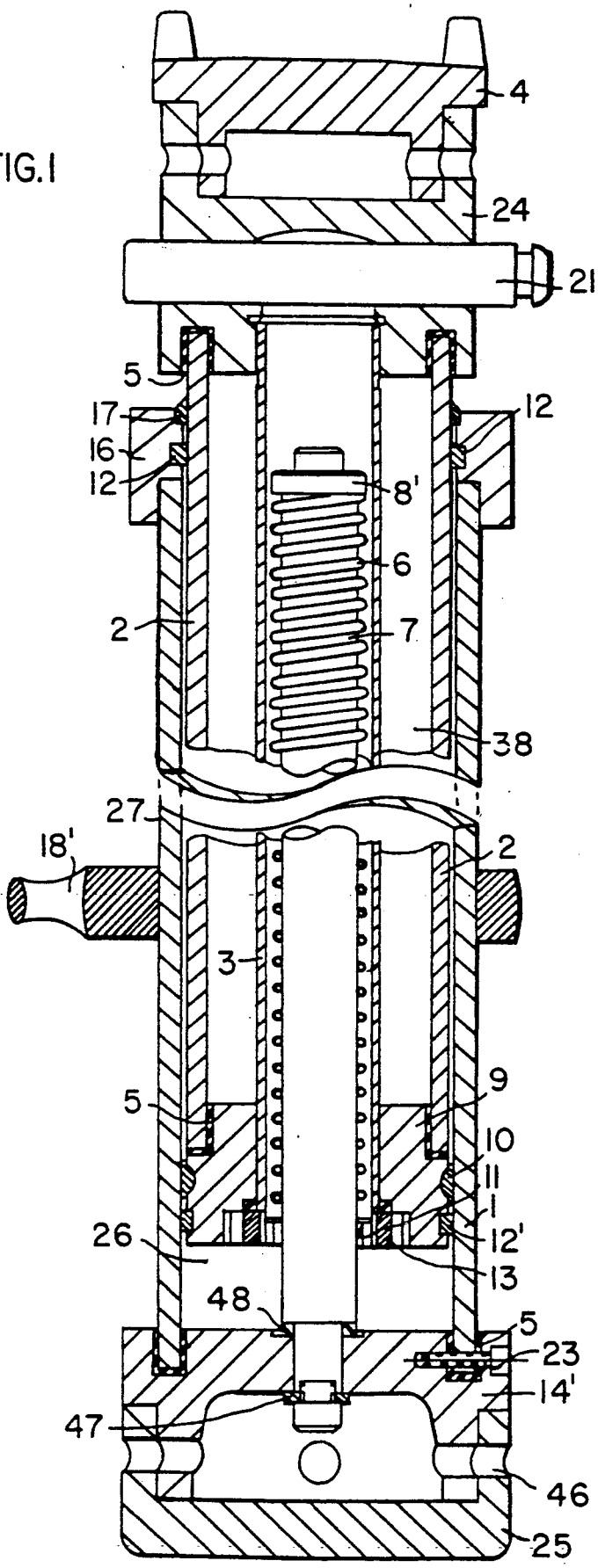
FIG. 1 is a longitudinal section through a steel mine prop with a head connection of the setting valve according to the invention.

A steel mine prop according to FIG. 1 comprises essentially an outer cylindrical tube 1, which is inserted at its lower face end into a corresponding face end groove of a cylindrical bottom 14' and is sealed by a liquid seal 5. If necessary, transversely directed holding screws 23 can be provided as a simple mechanical lock. However, these screws cannot and should not transfer any appreciable mechanical loads. The cylindrical bottom 14' is inserted in a conventional manner in a so-called prop foot 25, which is attached to the cylindrical bottom 14', for example, by tension sleeves, of which only the bores 46 are illustrated.

An end collar 16, which may also be split, is put onto the other face end of the outer cylindrical tube 1 and centered by a simple centering projection. This end collar 16 comprises an inner guide ring 12 for an inner cylindrical tube 2 and a dirt scraper 17 for cooperating with the inner cylindrical tube 2. An inner cylindrical tube 2 is guided longitudinally slideably, displaceably in the outer cylindrical tube 1 by the end collar 16 with its guide ring 12 arranged on the end collar 16. In the interior of the outer cylindrical tube 1, the inner cylindrical tube 2 comprises a piston 9 at the tube's facing end. This piston 9 comprises a receiving projection, which is not described in further detail, by means of which it can be pushed into the interior of the tube 2. Thus, the face end of the cylindrical tube 2 comes to rest against the end of the mentioned projection of the piston 9. This connection region of the inner cylindrical tube 2 with the piston 9 can in turn simply be sealed, preferably by means of the above mentioned liquid seal 5. The piston 9 is guided in the outer cylindrical tube 1 by means of a guide ring 12' and is sealed by means of a piston seal ring 10.

The outer facing end of the inner cylindrical tube 2 is inserted into a facing end annular groove of a valve housing 24, which groove is not described in further detail, and is sealed there in turn, preferably by means of the liquid seal 5. A setting and withdrawal valve 21 which is known as such, is located in this valve housing 24. The valve housing 24 is formed on its upper side so that it can receive a prop head 4, which can be joined to the valve housing 24 and which can be supported by the valve housing 24, so that the support force can be transmitted through the prop head 4 and through the valve housing 24 onto the inner cylindrical tube 2.

On the inner side of the valve housing 24, a bore which is not described in further detail, is provided and extends coaxially with the longitudinal axis of the steel mine prop. The bore is connected to the bore for the setting and withdrawal valve 21, and is equipped with a threading at its end pointing toward the interior of the cylinder. A tube 3 is screwed into this threading, and is sealed in this thread region, in a manner not illustrated in detail, such that a pressure, which arises in the interior of the tube 3, cannot be communicated to its outside.

The other facing end of the tube 3 passes through a corresponding coaxial bore of the piston 9, which bore is not described in further detail. There the tube 3 is connected by means of a threaded nut 13, which can be embodied as a groove nut or circular nut. In this context, the threaded nut 13 is supported by its inner flat surface against the corresponding counter surface of a recess of the piston 9, and is also sealed in this region, so that a pressure arising in the pressure chamber 26 cannot be communicated in this region to the outside of the tube 3. At the end connected to the threaded nut 13, the inner side of the tube 3 comprises a stop ring 11, against which a helical compression spring 6 is supported with its lower end. The helical compression spring 6 extends into the interior of the tube 3, so that this tube 3 can also be referred to as a spring guide tube. However, as can be seen from the arrangement, the tube 3 joins the valve housing 24 and therewith the prop head 4 to the piston 9, so that the tension forces created between these parts, are taken up by the tube 3. However, the tube 3 does not take up compression forces. On the contrary, these are taken up by the cylindrical tube 2. The cross-section of the wire of which the spring 6 is made, may be round as shown or the spring wire may have a square or rectangular cross-sectional configuration.

The spiral compression spring 6 is supported at its upper end against a support element or stop 8 which is arranged at an inner upper free end of a tension element 7 embodied as a rod. The lower end of the tension element or rod 7 passes through a corresponding bore in the cylindrical bottom 14= and is held in this position against being pulled out, by means of a retaining ring 47. A seal 48, arranged on the inner side, assures that at this location the pressure in the pressure chamber 26 cannot be communicated to the outside.

Due to the described arrangement of the spiral compression spring 6, it has the tendency to displace the piston 9 in the direction toward the cylindrical bottom 14' and thereby to retract the cylindrical tube 2. This is possible in a corresponding control position of the setting and withdrawal valve 21, namely when it is in the withdrawal position. The liquid present in the pressure chamber 26 is then displaced by the piston 9 due to the spring force of the helical compression spring 6 whereby the liquid is pressed through the inner chamber of the tube 3, which still has sufficient space for this purpose, and to the valve 21 and from there to the outside.

In the opposite direction, that is, when the prop is to be extended for supporting the hanging roof of a seam or mine, the valve 21 is moved into the setting position so that the pressure medium—generally plain water—can flow from the valve 21 into the interior of the tube 3 and from there into the pressure chamber 26. Hereby, the piston 9 and therewith the cylindrical tube 2 with its outer accessory structures are extended until the prop head 4 makes contact. If, however, the prop has been embodied too short for any reason, then the compression spring 6 merely assumes a blocking function, whereby a further extension movement is prevented. Tensile loads do not arise on the outer cylindrical tube 1 or on the end collar 16. A stop bushing is not required between the inner cylindrical tube 2 and the outer cylindrical tube 1. Corresponding surface damage that could be caused by such a bushing is avoided.

Figure 3:
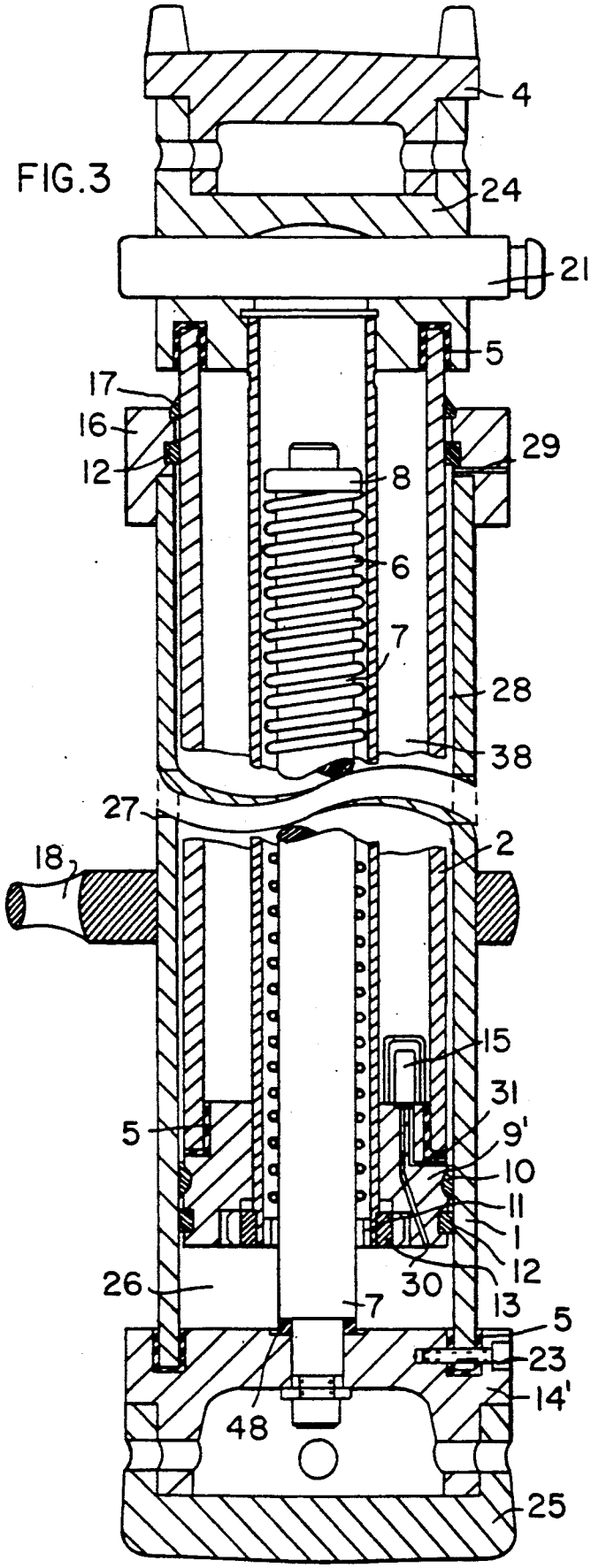
FIG. 3 shows a longitudinal section as in FIG. 1, however with a high pressure relief valve at the piston.

A handle 18 shown in FIG. 3 is arranged on the outer surface 27 of the outer cylindrical tube 1. The handle 18 is embodied in split form but not illustrated in detail, and therefore the handle 18 can be clamped on the mentioned outer surface 27 or be displaced on it.

Figure 2:
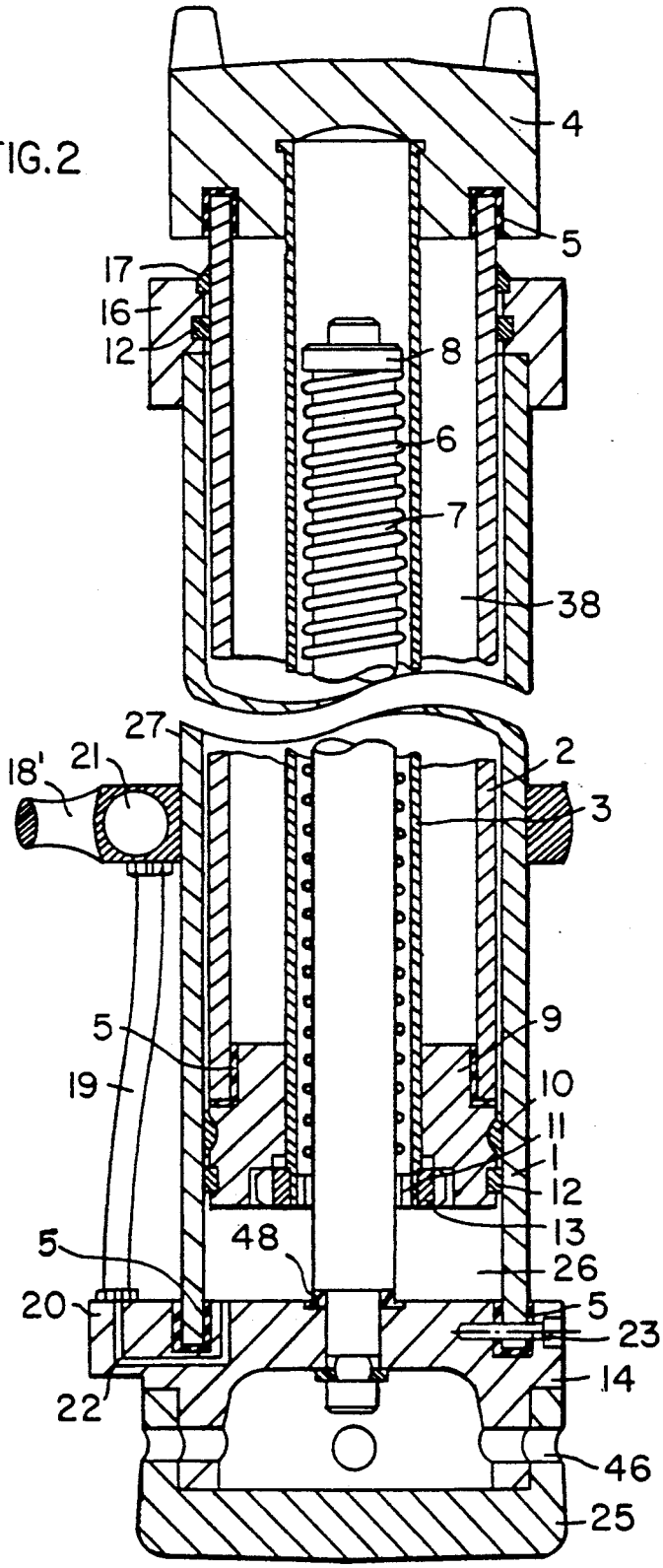
FIG. 2 shows a longitudinal section through a steel mine prop with a bottom connection of the setting valve and arrangement of the setting valve in the hand grip arranged on the outer cylindrical tube.

The embodiment according to FIG. 2 is almost identical in its internal construction to the embodiment according to FIG. 1. Therefore, reference can be made to the above description of FIG. 1. In the embodiment according to FIG. 2, the prop head 4 is merely integrally formed without the valve housing 24 described for FIG. 1. In place thereof, according to the embodiment of FIG. 2, the valve housing for the valve 21 is formed by a part 18' of the handle arranged on the outer surface 27 of the outer cylindrical tube 1. In the embodiment according to FIG. 2 the valve 21 is then joined to a connection piece 20 by means of a high pressure hose 19 joined pressure tightly to the first part 18'. The connection piece 20 is formed as an outer cam on the cylindrical floor 14. A bore 22 passes through this connection piece 20 and the adjoining part of the cylindrical floor 14, into the interior of the pressure chamber 26, and passes below the annular groove, not described in detail, for receiving the outer cylindrical tube 1 so that the associated sealing region of the seal 5 is not touched. The mode of operation of the prop and the remaining construction is the same as described above with reference to FIG. 1. This arrangement has the advantage that the setting and withdrawal valve 21 is always easily accessible even for large extension stroke lengths of the prop, and that, during the setting or withdrawal of the prop, its height position is not changed.

FIG. 3 shows a prop, which is identical in its construction in all essential characteristics to the prop according to FIG. 1. Hence, reference can be made to the description of the prop of FIG. 1. In the embodiment according to FIG. 3, however, the piston 9' comprises an excess pressure relief valve 15, which often is described as a working valve, and which is connected at its inlet through a bore 30 to the pressure chamber 26, and at its outlet through a bore 31 to the intermediate chamber 28 between the outer cylindrical tube 1 and the inner cylindrical tube 2. Hereby, the mouth of the bore 31 lies above the piston seal ring 10 so that an unhindered entry to the mentioned intermediate chamber 28 is possible.

Simultaneously, the end collar 16 comprises at least one relief bore 29, which, on the one hand, terminates into the intermediate chamber 28 and, on the other hand, leads freely into the ambient air.

In case of overloading of the prop, the described excess pressure relief valve 15 at the piston 9' typically allows a retraction of the inner cylindrical tube 2 by an extent suitable to decrease the overload, which is achievable in that the pressure of the pressure medium is decreased by appropriately bleeding the pressure medium from the pressure chamber 26 by means of the excess pressure relief valve 15. The special arrangement and connection according to FIG. 3 now makes it possible to bleed off the excess pressure from the pressure chamber 26 through the bore 30 and through the excess pressure relief valve 15 and the outlet bore 31 into the intermediate chamber 28 to thereby flush the water, which is typically used as the pressure medium, into this intermediate chamber 28, and thereby simultaneously to wash this intermediate chamber free of dirt particles. The water exiting from the bore 31 then can leave the intermediate chamber 28 through the relief bore 29. This cleaning process not only can occur upon overloading of the prop, but also can be intentionally caused to occur by running the pressure medium to excess pressure. In this manner, an active cleaning of the intermediate chamber 28 is made possible for the first time.

Figure 4:
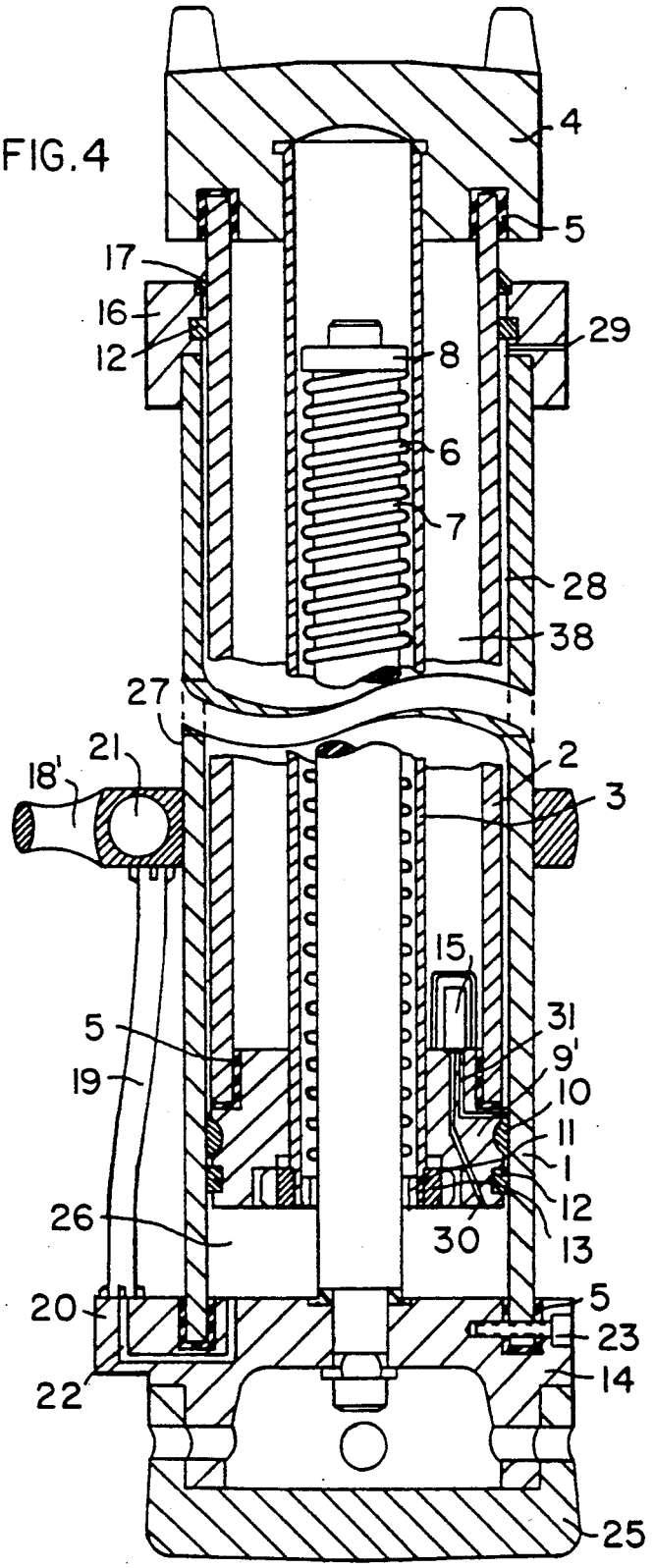
FIG. 4 is a longitudinal section as in FIG. 2, however with an excess pressure relief valve at the piston.

FIG. 4 shows a prop with the construction according to FIG. 2. However, in the embodiment of FIG. 4, just as in the embodiment of FIG. 3, the over-pressure relief valve 15 is provided at the piston 9' in the same arrangement and function as described with reference to FIG. 3.

Figure 5:
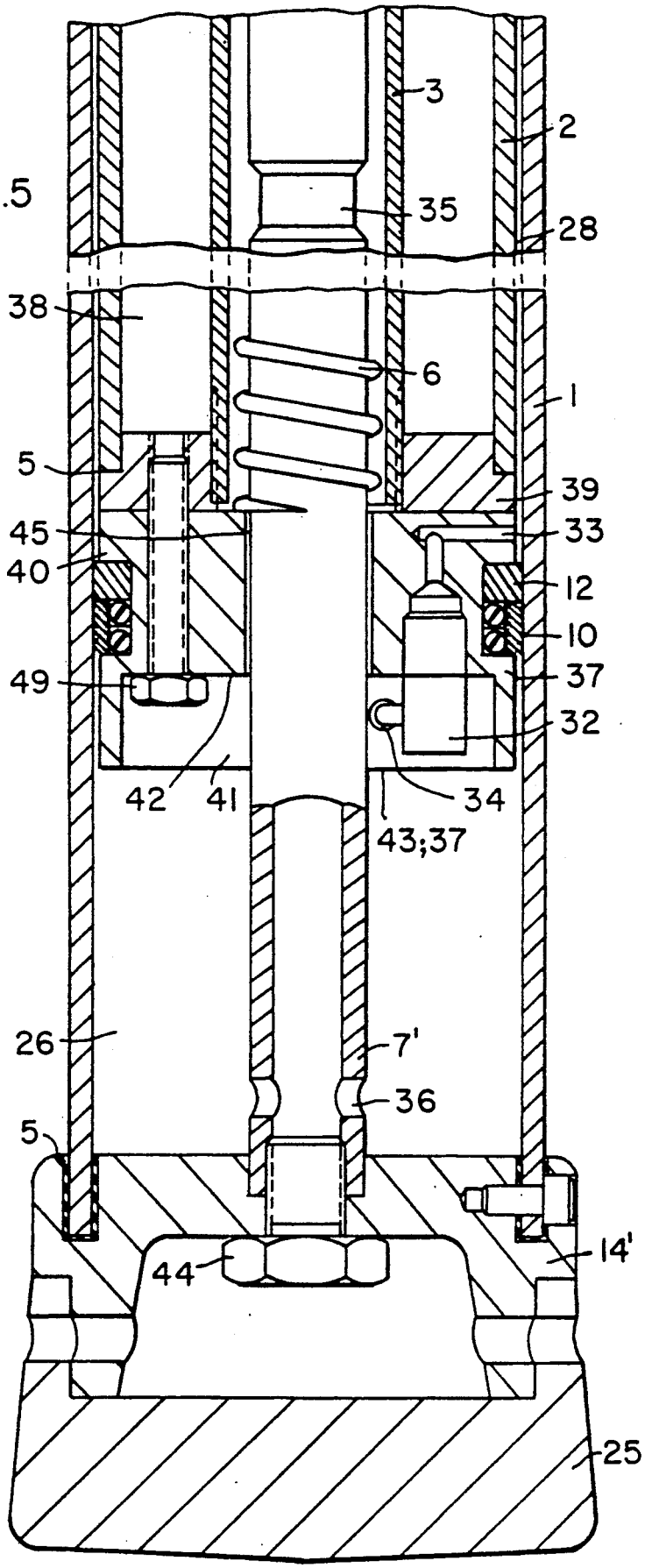
FIG. 5 shows a portion of a longitudinal section through a steel mine prop with a safety valve at the piston for limiting the extension stroke.

FIG. 5 shows a construction of a mine prop according to the invention which deviates in essential points from the above described constructions. However, the differences relate only to the inner parts. The outer cylindrical tube 1 and the inner cylindrical tube 2 comprise, at their respective facing ends, the same arrangements as have been described above with reference to FIGS. 1 to 4. In this context, in the region of the prop head 4, the tube 3 serving as a spring guide tube is attached to the prop head 4 or to a valve housing 24 in a similar manner as has already been described with reference to FIGS. 1 to 4. In the example embodiment according to FIG. 5, however, the inner piston 37, connected to the inner cylindrical tube 2, is equipped with a safety valve 32. For this purpose, in the example embodiment according to FIG. 5, the piston 37 is divided transversely into two parts, one part of which is embodied as a tube end plate 39 and is connected, similarly as the pistons 9 and 9', by a seal 5 to the inner cylindrical tube 2 on its facing end. This tube end plate 39 comprises a concentric bore with a threading, into which the tube 3 is screwed by means of a corresponding threading which is not designated in detail, and is sealed off.

A stop element 40, actually serving as the piston, is screwed by means cf screws 49 onto this tube end plate 39 on the end facing toward the pressure chamber 26. These screws 49 are also sealed so that pressurized medium from the pressure chamber 26 cannot pass to the outside of the tube 3 and thereby into the inner chamber 38. While, in principle, this would not be damaging, it would, however, mean that pressure medium, generally water, is present in this chamber 38, whereby the total weight would be unnecessarily increased.

The stop element 40 comprises a central bore 45, which is somewhat smaller in its diameter than the inner diameter of the tube 3, so that the helical compression spring 6 arranged in the tube 3, can be supported on its facing end in the region of the central bore 45 by the stop element 40.

The stop element 40 comprises a recess 41 with a bottom 42. The safety valve 32 is fitted in a bore in the bottom 42, which bore is not referenced in detail, deeply enough that it does not project above the upper edge 43 of the recess 41. Hereby, it is ensured that when the bottom of the piston 37 abuts against the cylindrical bottom 14', the corresponding load need not be taken up by the safety valve 32.

The safety valve 32 is joined by means of a bore 33 to the intermediate chamber 28. For this purpose, the bore 33 passes above a guide ring 12 and a piston sealing ring 10 of the stop element 40 into the intermediate chamber 28, so that there the pressure fluid can emerge unhindered. The inlet side of the safety valve 32 joined to the pressure chamber 26 is not shown in detail and is provided at the valve itself.

For its operation, the safety valve 32 comprises a cam 34, which has a running wheel, not referenced in detail, which contacts the outer surface of a tension element 7' embodied as a rod or tube, whereby the safety valve 32 is closed when it contacts the tension element 7'. The tension element 7' in turn can essentially be embodied like the tension element 7 according to FIGS. 1 to 4. However, while in the embodiments according to FIGS. 1 to 4, the helical compression spring 6 was driven into a blocking state in the fully extended state of the prop, whereby the tension-load on the tension element 7 corresponded to the entire prop support force, such a load no longer occurs in the tension element 7' nor in the helical compression spring 6 in the embodiment according to FIG. 5. Namely, the tension element 7' comprises an annular groove 35, which is provided axially in such a position that when the prop has been extended so far, that the spiral compression spring is just before the blocking position, the cam 34 drops into the annular groove 35 and thereby opens the safety valve 32. The pressure chamber 26 is hereby depressurized and the pressure medium is blown to the outside through the bore 33 into the intermediate chamber 28 and from there, for example, through relief bores 29 in the end collar 16. Thus, a further extension of the cylinder is impossible whereby the tension element 7' only has to take up the tension load resulting from the relatively small spring force of the helical compression spring 6. Therefore, it is also possible to construct the tension element 7' as a tube, which is fitted at its end facing the cylindrical bottom 14' into a corresponding recess of the cylindrical bottom 14' and is sealed there. In this region it can comprise an inner thread which is not referenced in further detail. A threaded stopper 44 fitted from the outside through the cylindrical bottom 14', is inserted into this inner thread, whereby the stopper 44 axially holds the tension element 7'.

If it is desired, the tension element 7', embodied as a tube, can also be open at its free facing end and comprise transverse bores 36, so as to avoid pressure being exerted by the pressure medium of the pressure chamber 26 onto the tension element 7'.

Figure 6:
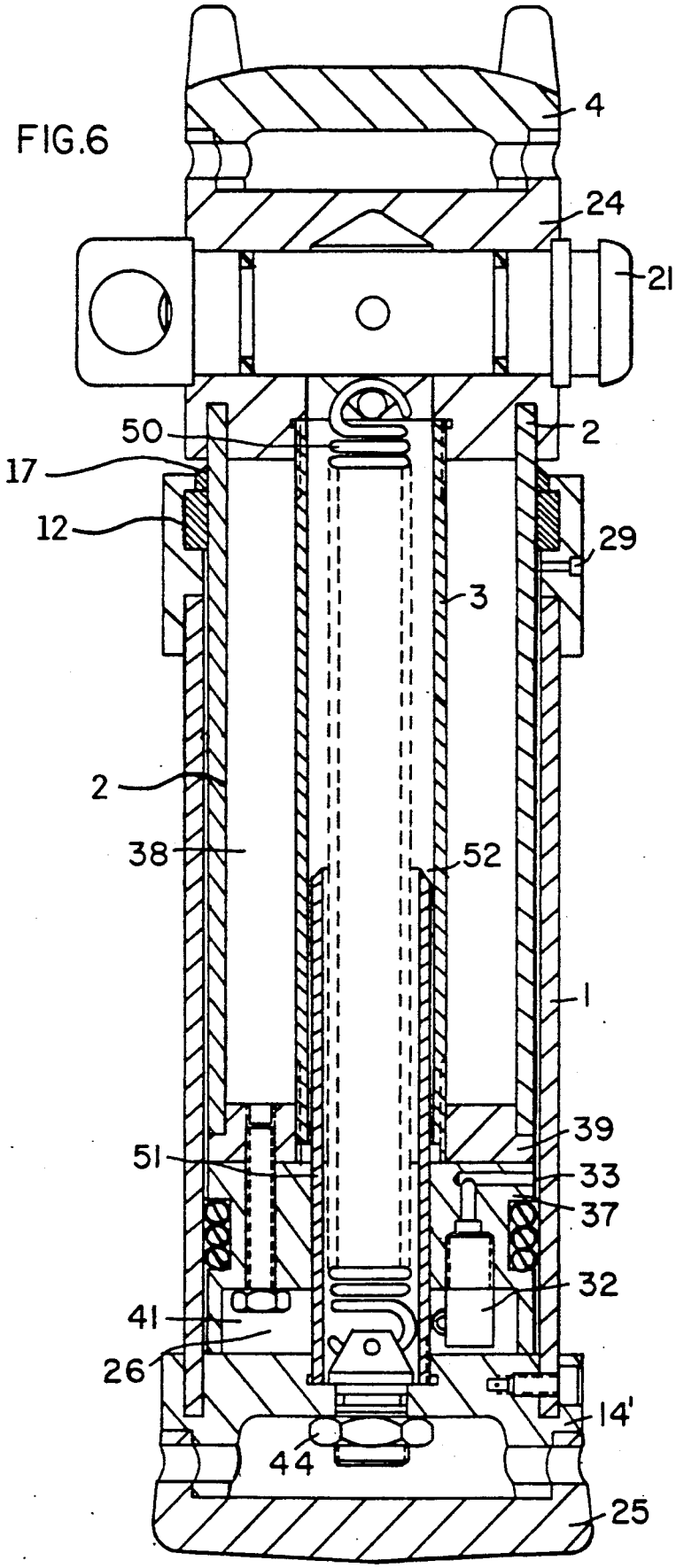
FIG. 6 illustrates another prop embodiment of the invention with a tension return spring.

The embodiment according to FIG. 6 presents a variation in which the return spring is embodied as a tension spring 50 in contrast to the compression spring 6 of the embodiments according to FIGS. 1 to 5. The example embodiment of FIG. 6 corresponds in its essential construction to the construction of the prop described with reference to FIG. 5. However, in the example embodiment according to FIG. 6, a tube 51 is used in place of the tension element 7' according to FIG. 5. The tube 51, just as the tension element 7' according to FIG. 5, extends through the piston 37 into the tube 3. The remaining construction of the arrangement according to FIG. 6 is just like the construction of the arrangement according to FIG. 5 except for the spring 50 which is a helical tension spring 50 operating as a return spring, which extends in the interior of the tube 3 on the one hand and tube 51 on the other hand. The spring 50 is attached at one end in a suitable manner to the prop head 4 or to the respective valve housing 24, and at its other end to the stopper 44. By means of this arrangement the spring 50, being under tension load, tends to contract and therewith tends to move the prop head 4 and the cylindrical bottom 14' closer together, whereby in the pressureless state of the prop it, the prop can be moved into position in a desired manner.

In the arrangement according to FIG. 6, the tube 51 serves simultaneously as a control rod for the safety valve 32. Namely, when the prop is extended out to its allowable limit position, the cam 34 of the safety valve 32 reaches the end 52 of the tube 51 so that the cam can extend unhindered and thereby open the safety valve 32 in the already described manner. In spite of maintaining this function, it is also possible to make the tube 51 longer if care is taken that a recess or a groove or a slot is provided at the position 52.

Although the invention has been described wit reference to specific example embodiments it will be appreciated that it is intended to cover all modifications and equivalents within the scope of the appended claims.

I claim:

1. A hydraulic steel prop for mines, comprising a first prop section and a second prop section, one of said first and second prop sections having a prop foot (14, 14', 25) while the other of said first said second prop sections has a prop head (4, 24), said first and second prop sections having an outer cylindrical tube (1) and an inner cylindrical tube (2) slidingly received in said outer cylindrical tube (1), one of said cylindrical tubes having a foot end secured to said prop foot, a first seal between said foot end and said prop foot, the other of said cylindrical tubes having a head end secured to said prop head, a second seal between said head end and said prop head, a guide collar (16) surrounding said outer cylindrical tube for guiding said inner cylindrical tube in said outer cylindrical tube, a piston (9) secured to said inner cylindrical tube for guiding said inner cylindrical tube inside said outer cylindrical tube, a third seal (10) between said piston and said outer cylindrical tube for sealing a compression chamber (26) in said outer cylindrical tube, a first tension member (3) interconnecting said prop head and said piston (9, 9') for taking up axial tension loads, a second tension member (7, 7') arranged coaxially inside said cylindrical tubes and slidably passing through said piston, means (47) securing a fixed end of said second tension member (7, 7') to said prop foot (14, 14', 25), a stop (8) at a free end of said second tension member (7, 7'), a compression spring (6) coaxially arranged around said second tension member (7, 7'), said compression spring (6) having one spring end bearing against said stop (8) and another spring end bearing against a support means (11, 40) for taking up an axial force tending to compress said compression spring, whereby said compression spring (6) has a biasing force tending to displace said piston (9) toward said prop foot, a setting and withdrawal valve (21) in said steel prop, and flow conduit means connecting said setting and withdrawal valve (21) to said compression chamber (26) through one of said prop head and said prop foot.

2. The steel prop of claim 1, wherein said first and second seals comprise a liquid seal (5) which solidifies and seals at room temperature and again becomes liquid at a suitably high temperature.

3. The steel prop of claim 1, wherein said first tension member (3) is constructed as a tension tube having one end attached to said prop head (4, 24) and an opposite end attached to said piston (9, 9').

4. The steel prop of claim 3, wherein said tension tube (3) is screwed directly to said prop head (4, 24) and said opposite end extends at least partially through said piston (9, 9') and is connected at this opposite end with a threaded nut (13), which bears axially against said piston (9, 9').

5. The steel prop of claim 1, comprising fourth seal means for pressure tightly sealing an inner chamber (38) in said inner cylindrical tube (2).

6. The steel prop of claim 5, wherein said fourth seal means comprise a sealing element between said piston (9, 9') and said inner cylindrical tube (2), and further sealing elements between said first tension member (3) and respective structural elements (4, 24; 13; 39) to which said first tension member (3) is attached.

7. The steel prop of claim 1, further comprising inner stop means (11, 40) forming said support means for supporting said other spring end of said compression spring (6) relative to one of said first tension member (3), said piston, and a structural part (13) connected to said piston (9, 9'), said inner stop means concentrically surrounding said second tension member (7, 7').

8. The steel prop of claim 1, wherein said compression spring (6) is constructed as a helical compression spring.

9. The steel prop of claim 8, wherein said first tension member (3) is a tubular member having an inner diameter slightly larger than an outer diameter of said helical compression spring (6) when said helical compression spring (6) is in its blocking state, said helical compression spring (6) being received inside said tubular member (3).

10. The steel prop of claim 1, wherein said second tension member (7, 7') is releasably attached to said prop foot (14, 14').

11. The steel prop of claim 1, wherein said prop head comprises two parts (4, 24), whereby an upper part (4) forms a prop head top, while a lower part is formed as a valve housing (24), wherein said setting and withdrawal valve (21) is mounted.

12. The steel prop of claim 1, wherein said first tension member is a tubular member (3), and wherein said setting and withdrawal valve (21) has an inlet and an outlet connected to said compression chamber (26) through said tubular member (3).

13. The steel prop of claim 1, further comprising a divided handle (18) operatively clamped to said outer cylindrical tube (1) in a slidable manner on the outer surface (27) of said outer cylindrical tube (1), wherein said handle (18) comprises a portion (18') forming a valve housing for said setting and withdrawal valve (21), which is connected to said compression chamber (26) through a flexible high pressure hose (19) connected to a bore (22) leading through said prop foot (14) into said compression chamber (26).

14. The steel prop of claim 1, further comprising a relief bore (29) in said guide collar (16) connecting ambient air with an intermediate chamber (28) between said outer and inner cylindrical tubes (1, 2).

15. The steel prop of claim 14, further comprising an excess pressure relief valve (15) arranged at said piston (9'), and wherein an inlet side of said excess pressure relief valve (15) is connected to said compression chamber (26), and wherein an outlet side of said pressure relief valve (15) is connected to said intermediate chamber (28).

16. The steel prop of claim 15, wherein said excess pressure relief valve (15) is arranged on the side of the piston (9') away from said compression chamber (26).

17. The steel prop of claim 16, wherein said inlet side and said outlet side of said excess pressure relief valve (15) are connected through bores (30, 31) to said compression chamber (26) and to the intermediate chamber (38), respectively, whereby the bore (31) for connecting said outlet side of said intermediate chamber (28) terminates directly above a piston sealing ring (10) of said piston (9').

18. A hydraulic steel prop for mines, comprising a first prop section and a second prop section, one of said first and second prop sections having a prop foot (14, 14', 25) while the other of said first and second prop sections has a prop head (4, 24), said first and second prop sections having an outer cylindrical tube (1) and an inner cylindrical tube (2) slidingly received in said outer cylindrical tube (1), one of said cylindrical tubes having a foot end secured to said prop foot, a first seal between said foot end and said prop foot, the other of said cylindrical tubes having a head end secured to said prop head, a second seal between said head end and said prop head, a guide collar (16) surrounding said outer cylindrical tube for guiding said inner cylindrical tube in said outer cylindrical tube, a piston (37) secured to said inner cylindrical tube for guiding said inner cylindrical tube inside said outer cylindrical tube, a third seal (10) between said piston and said outer cylindrical tube for sealing a compression chamber (26) in said outer cylindrical tube (1), a tension tubular member (3) interconnecting said prop head and said piston (9) for taking up axial tension loads, and wherein said piston (37) comprises a safety valve (32) which, in a predetermined end position of said piston (37) connects said compression chamber (36) to the atmosphere through a bore (33), through an intermediate chamber (28) between said outer and inner cylindrical tubes (1, 2), and through at least one relief bore (29) connecting said intermediate chamber (28) to the atmosphere, said prop further comprising a spiral tension spring (50) acting as a return spring arranged under tension between said prop head (4, 24) and said prop foot, said return spring (50) being surrounded by said tubular member (3) for taking up tension loads and by a further tube (51), which is attached to said prop foot, said further tube (51), at least in the retracted state of the prop, extending telescopically into said tubular member (3) and surrounding said spiral tension spring (50), wherein said safety valve (32) is operated by said further tube (51) when said piston (37) is in a certain position.

19. The steel prop of claim 18, wherein said safety valve (32) comprises a cam (34) for its operation by said further tube (51), said cam (34) contacting a surface of said further tube (51), said safety valve (32) being switched into a different state by a change in a surface contour of said further tube (51), said surface contour change corresponding to said certain position.

20. The steel prop of claim 18, wherein said surface contour change is embodied as one of an annular groove (35), a depression, a cut-in, and a slot in said further tube (51).

21. The steel prop of claim 19, wherein said surface contour change is embodied as an end edge (52) of said further tube (51).

22. The steel prop of claim 18, wherein said piston (37) comprises a recess (41) on its side facing toward said compression chamber (26), said safety valve (32) being inserted in said recess (41) deep enough, so that said safety valve does not project above an end edge (43) of said recess (41) toward said compression chamber (26), said safety valve (32) having an outlet connected to a relief bore (33).

23. The steel prop of claim 18, wherein said further tube (51) is operatively attached to said prop foot.

24. The steel prop of claim 18, wherein said piston (37) is divided transversely and comprises a tube end plate (39) facing said inner cylindrical tube (2), a stop element (40) facing said compression chamber (26), and means (49) axially connecting said tube end plate (39) and said stop element (40) to each other.

25. The steel prop of claim 24, wherein said safety valve (32) is mounted in a recess (41) of said stop element (40), said stop element (40) comprising a relief bore (33), at least one guide ring (12), and at least one sealing ring (10), and a central bore (45), whereby an inner wall of said bore (45) is spaced from an outer surface of said further tube (51), so that a gap exists for a pressure medium to pass through.

26. The steel prop of claim 1, wherein said second tension member (7') is hollow along at least part of its length, said prop further comprising a threaded stopper (44) connecting said second tension member to said prop foot.

27. The steel prop of claim 1, wherein said piston (37) is divided transversely and comprises a tube end plate (39) facing said inner cylindrical tube (2), a stop element (40) facing said compression chamber (26), and means (49) axially connecting said tube end plate (39) and said stop element (40) to each other.

28. The steel prop of claim 27, further comprising a safety valve (32) mounted in a recess (41) of said stop element (40), said stop element (40) comprising a relief bore (33), at least one guide ring (12), and at least one sealing ring (10), and a central bore (45), whereby an inner wall of said bore (45) is spaced from an outer surface of said second tension member (7'), so that a gap exists for a pressure medium to pass through.

* * * * *